US011406193B2

(12) United States Patent
Schmidt-Klimak

(10) Patent No.: US 11,406,193 B2
(45) Date of Patent: Aug. 9, 2022

(54) PAD FOR IMPROVING SITTING POSTURE

(71) Applicant: Ideanet Limited, Hong Kong (CN)

(72) Inventor: Judit Schmidt-Klimak, Hong Kong (CN)

(73) Assignee: Ideanet Limited, Hong Kong (CN)

( * ) Notice: Subject to any disclaimer, the term of this patent is extended or adjusted under 35 U.S.C. 154(b) by 0 days.

(21) Appl. No.: 17/257,618

(22) PCT Filed: Jul. 3, 2019

(86) PCT No.: PCT/CN2019/094534

§ 371 (c)(1),
(2) Date: Jan. 4, 2021

(87) PCT Pub. No.: WO2020/007315

PCT Pub. Date: Jan. 9, 2020

(65) Prior Publication Data

US 2021/0298480 A1 Sep. 30, 2021

(30) Foreign Application Priority Data

Jul. 4, 2018 (CN) ..... 201821048934.2

(51) Int. Cl.
*A47C 7/02* (2006.01)
*A47C 7/14* (2006.01)
*A47C 27/08* (2006.01)

(52) U.S. Cl.
CPC ..... *A47C 7/021* (2013.01); *A47C 27/083* (2013.01)

(58) Field of Classification Search
CPC ..... A47C 7/021; A47C 27/083
(Continued)

(56) References Cited

U.S. PATENT DOCUMENTS 679,915 A * 8/1901 Rudolf ..... A47C 7/029
297/452.26 X
3,276,047 A * 10/1966 Emery ..... A47C 7/021
297/452.41 X (Continued)

FOREIGN PATENT DOCUMENTS

GB 2450368 A * 12/2008 ..... A47C 7/029

*Primary Examiner* — Rodney B White
(74) *Attorney, Agent, or Firm* — George G. Wang; Bei & Ocean

(57) ABSTRACT

A cushion for improving sitting posture, comprising a cushion body (1). The cushion body (1) can be placed on a plane. At least two hump portions (11 and 13) are formed on the cushion body (1). The two hump portions (11 and 13) are a first hump portion (11) and a second hump portion (13), respectively. The first hump portion (11) and the second hump portion (13) are used for supporting the parts of a human body corresponding to the front and back of the pelvis (3), respectively. The first hump portion (11) and the second hump portion (13) are arranged at an interval, so that a trench (12) is formed on the cushion body (1) between the first hump portion (11) and the second hump portion (13). The trench (12) is used for supporting the part of the human body corresponding to the lower end of the ischium or the lower end of the sacrococcyx. The cushion can relax the hip joint and surrounding muscles of the human body so as to facilitate blood supply, can ensure that the human spine always tends to maintain a correct curve so as to protect the lumbar vertebrae (2) of the human body, and can also further relax the cervical vertebrae and surrounding neck muscle tissues so as to prevent backache and headache.

9 Claims, 9 Drawing Sheets

(58) Field of Classification Search
USPC .... 297/393, 452.21, 452.23, 452.25, 452.26, 297/452.28, 452.41
See application file for complete search history.

(56) References Cited

U.S. PATENT DOCUMENTS 3,503,649 A * 3/1970 Johnson ..... A47C 7/029 297/452.26
4,285,081 A * 8/1981 Price ..... A47C 7/383 297/393 X
4,550,458 A * 11/1985 Fiore ..... A47C 7/383 297/393
4,607,882 A * 8/1986 Opsvik ..... A47C 7/029 297/452.23 X
5,313,678 A * 5/1994 Redewill ..... A47C 21/003 297/393 X
5,473,313 A * 12/1995 Graebe, Jr. ..... A47C 4/54 297/452.41
5,487,197 A * 1/1996 Iskra, Jr ..... A61G 5/1091 297/452.41 X
5,490,717 A * 2/1996 Greene ..... A47C 3/16 297/452.41
5,657,499 A * 8/1997 Vaughn ..... A61G 7/057 297/452.41 X
5,974,607 A * 11/1999 Smith ..... A61G 7/072 297/393
6,845,534 B1 * 1/2005 Huang ..... A47C 7/383 297/393
6,859,965 B1 * 3/2005 Gourd ..... A47C 7/383 297/393
6,957,462 B1 * 10/2005 Wilcox ..... A47C 7/383 297/393
2010/0237675 A1 * 9/2010 Merritt ..... B60N 2/2851 297/393
2014/0284988 A1 * 9/2014 Gefen ..... A61B 5/6894 297/452.41
2014/0290667 A1 * 10/2014 Masui ..... A47C 7/425 128/845
2015/0061346 A1 * 3/2015 Featherstone ..... A47C 7/021 297/452.41
2017/0013978 A1 * 1/2017 Rosenberg ..... A47G 9/1081

* cited by examiner

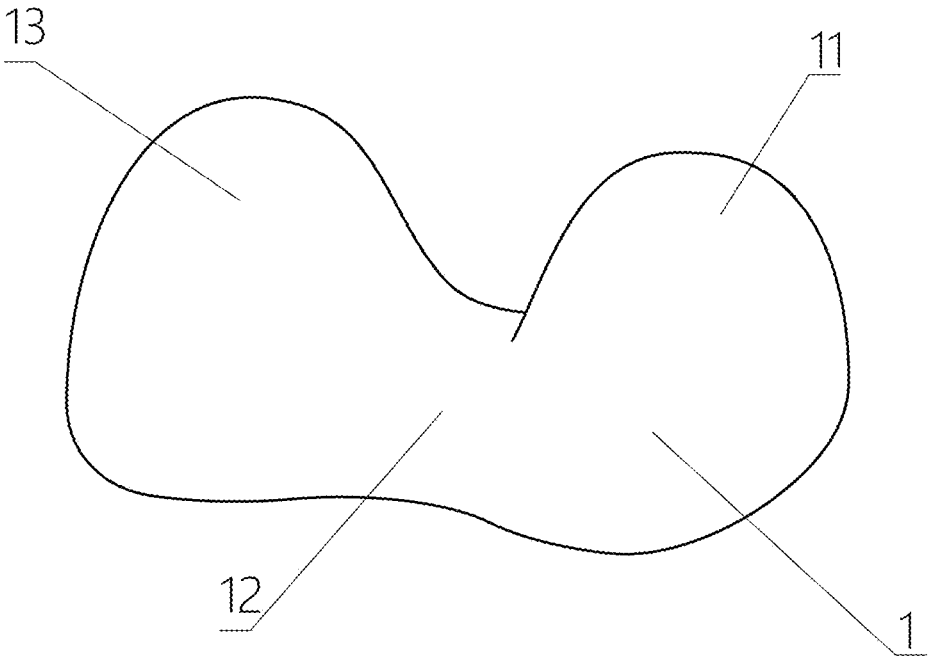
Fig. 1.1

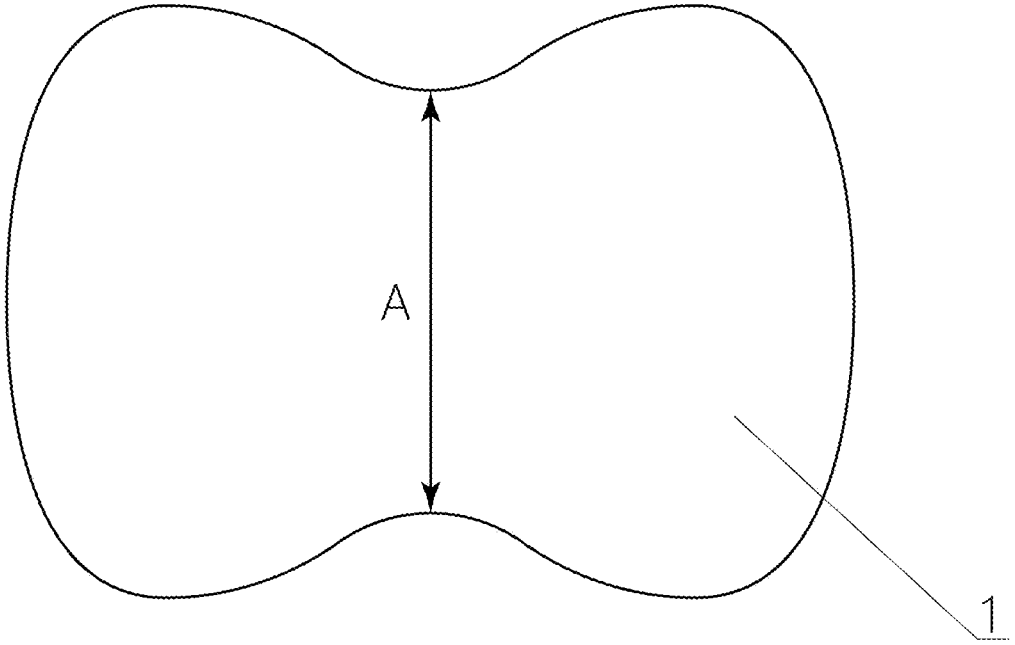
Fig. 1.2

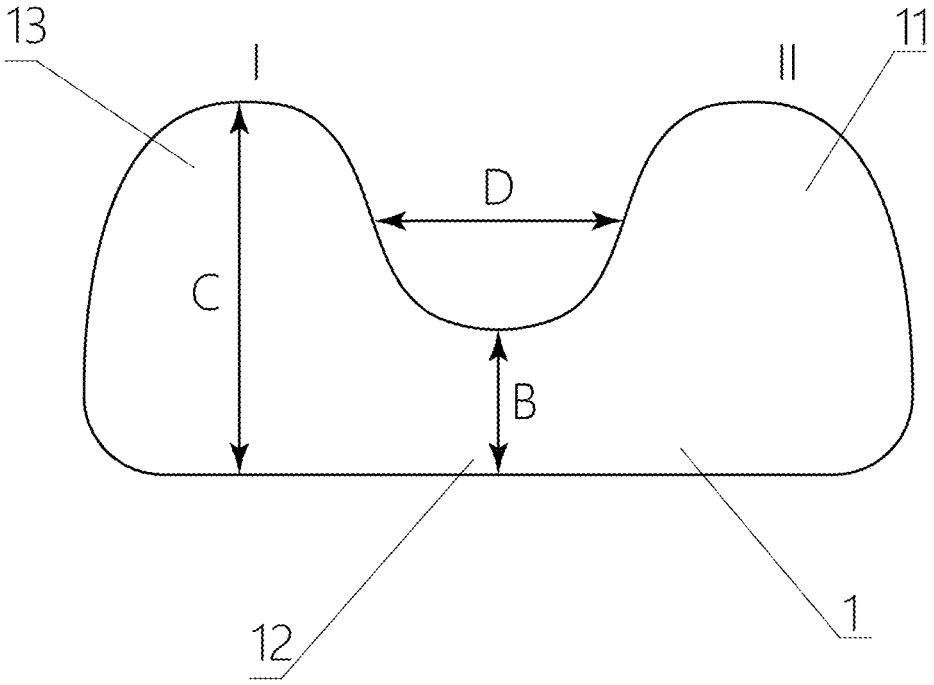
Fig. 1.3

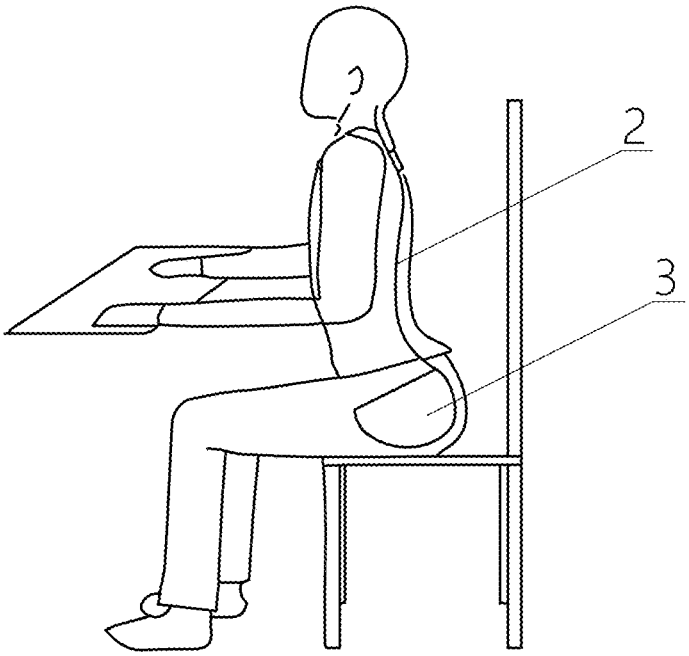
Fig. 2.1

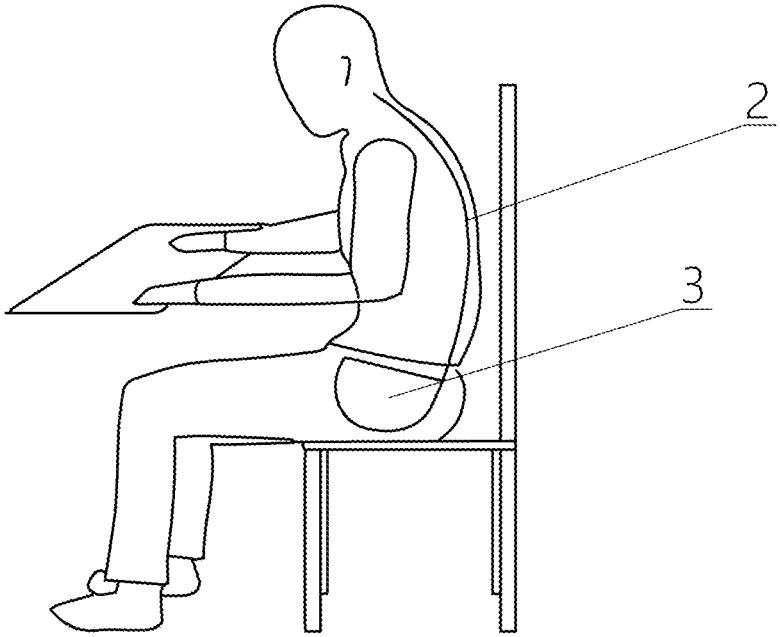
Fig. 2.2

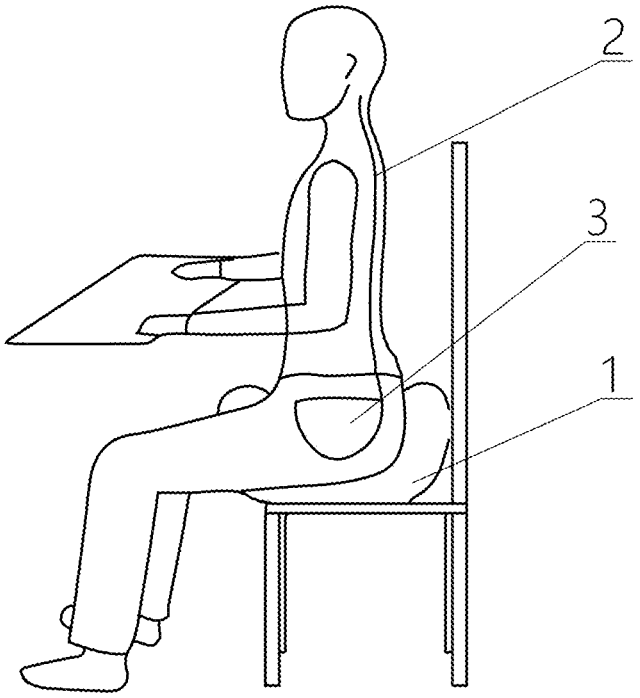
Fig. 2.3

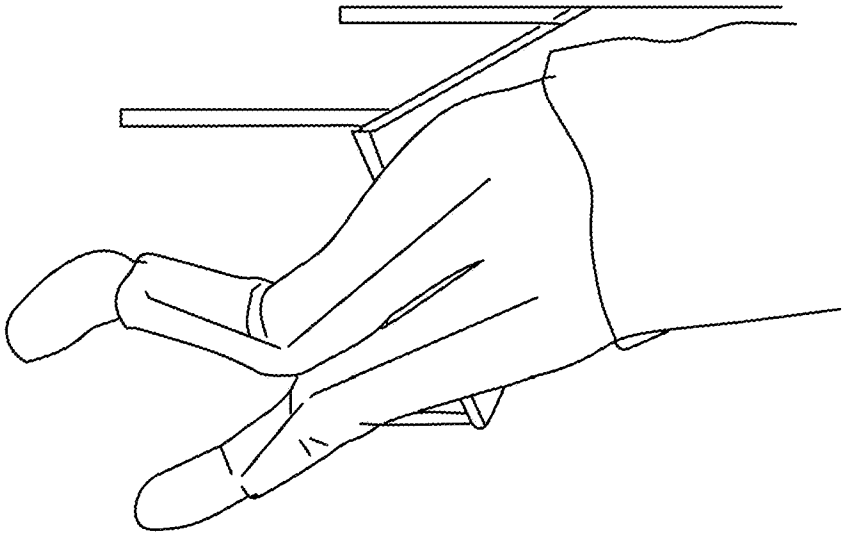
Fig. 3.1

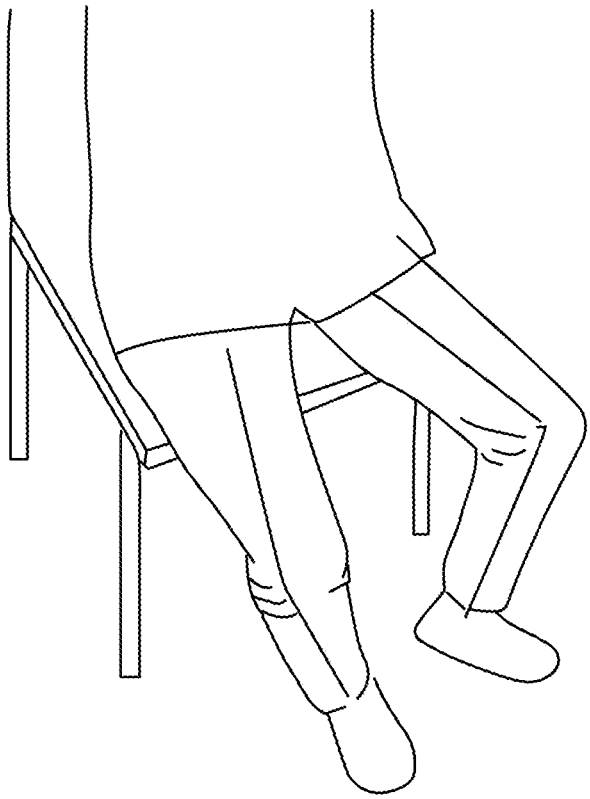
Fig. 3.2

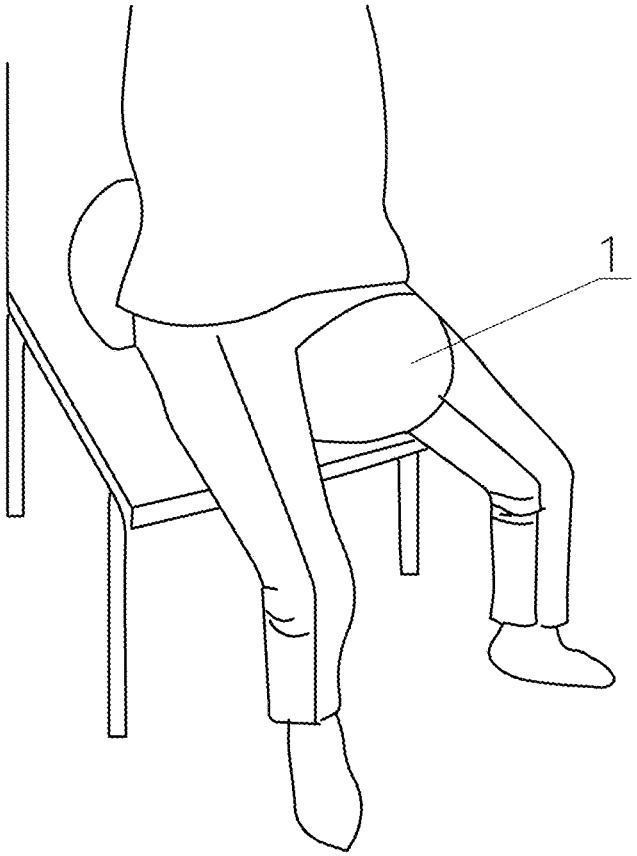
Fig. 3.3

PAD FOR IMPROVING SITTING POSTURE

BACKGROUND OF THE INVENTION

Field of Invention

The present disclosure relates to the field of houseware, and more particularly relates to a pad for improving sitting posture.

Description of Related Arts

The WHO (World Health Organization) reported as early as in 2003 that sitting around was tied to more than 2 million deaths annually worldwide. It is predicted that by 2020, 70% diseases will be caused by too much sitting, which therefore is listed as one of ten major death or disease-caused killers.

A domestic survey shows that currently in China, 43% people sit in the office at least for 8 hours, among whom only 31% occasionally stretch a bit, 27% walk a while out of the office, and more than 30% play computer games or browse recreational web sites when they are at rest.

At abroad, the population sitting around is not a small number. Most Americans at least sit for eight or nine hours per day, and the noon break time is only 1 hour. The Germans sit in offices for eight hours daily, and the noon break time is 2 hours. However, since most people live in suburbs, the time for driving or taking trains also last for five to eight hours. At work time, the Japanese sit for eight to twelve hours, and when they are working, the time will be even longer.

In recent years, as the life pace becomes ever faster, the sedentary population expands expeditiously. Besides IT practitioners, high-school students, taxi and bus drivers, governmental staff, office employees, accountants and other occupation practitioners are also sitting too much, and such populations are referred to as "sedentary populations."

The "sedentary populations" are highly susceptible to lumbar vertebrae diseases and cervical spondylosis. This is because they need to work at their desks for a long time without changing their postures, such that it is hard to keep their waist upright, which causes a huge detriment to their bodies.

For the waist, when a person sits around for a long time, the weight of body will concentrate against the lumbosacral part. Such unbalanced pressure distribution will easily cause lumbar muscle strain and pain; if such a condition lasts for a long term, it possibly causes decline of intervertebral disc tissue resilience and spine hyperosteogeny;

For the intestines and stomach, sitting around causes a slower enterogastric peristalsis; besides reducing secretion of digestive juice, which affects digestion, it will also induce and acerbate digestive diseases such as bloating and constipation, as well as obesity;

For the neck, because the cervical vertebra constantly maintains a forward bend posture and the posterior cervical muscles are in a strained state for a long time when sitting around, it always occurs that the back muscles ache and pain, the activity of cervical vertebra is appreciably limited, and the upper limbs are radiatively painful and numb; it even causes disorder of cervical facet joints, cervical muscle strain, stiff neck, back muscle fasciitis and even cervical spondylosis.

Studies show that a correct sitting posture may reduce the impairment of sitting around to the body. However, without assistance of external force, it is usually hard for a person to keep a correct sitting posture for a long time. Therefore, a pelvis of the person will naturally tilt backward or forward. This causes position displacement between sacrum and waist area and forces the entire spine into an unnatural position, which causes a negative impact on back health.

The prior art has proposed some pads for improving sitting posture. For example, the Chinese utility patent 201520685849.7 provides a multifunctional pad that may correct the sitting posture for preventing lumbar disc herniation and cyrtosis. For another example, the U.S. Pat. No. 5,887,951 discloses a posture correcting pad for shaping hips, entitled "Orthopedic Seating Orthosis for Correcting Posture and Restricting Gluteal Spreading."

However, pads of such types generally have the following problems:

The focus of such a pad is always on how to shape, such that the shape of the pad per se is only designed for supporting the human body. This causes that the function of the pad is mostly to passively maintain the shape of the human body, unable to cause the human body to adaptively adjust its own muscles to maintain the posture, such that they do not have a good effect in improving the posture.

Moreover, because the prior art only focuses on the curves of hip, waist and back of a person, not on the legs, it is hard for them to relieve the hip joints; therefore, besides a poor comfort, their help to back health is also limited.

SUMMARY OF THE INVENTION

To solve the technical problems above, the present disclosure provides a pad for improving sitting posture, comprising:

a pad body that may be placed on a plane;

at least two elevated segments formed on the pad body, the two elevated segments being referred to as a first elevated segment and a second elevated segment, respectively, wherein the first elevated segment and the second elevated segment are configured for supporting a pelvis of a human body from the front and the back, respectively; and bridge part formed between the first elevated segment and the second elevated segment, which are spaced with an interval, of the pad body, wherein the bridge part is configured for supporting a part corresponding to a lower end of an ischium or a lower end of a coccyx of the human body.

Compared with the prior art, the pad provided by the present disclosure enables relief of the hip joints and surrounding muscles of a human body by virtue of the separation function of the elevated segments, which guarantees that when sitting on the pad, the legs of the human body maintains a correct relaxed angle, thereby facilitating blood supply; guarantees that the spine of the person constantly approaches to maintaining a correct curve, thereby further protecting lumbar vertebrae, because the bridge part and the elevated segments surrounding the front and the back of the pelvis cause the pelvis to be straightened; and further relaxes the cervical spine and surrounding neck musculature to prevent back pain and headache because the pad for improving the sitting posture provided by the present disclosure may stretch the spine of the human body, while the stretched spine may affect the head posture.

The present disclosure helps to relieve the following health issues: bladder weakness, recurrent cystitis, urinary incontinence, prostate problems, uterus, rectal or vaginal prolapse, acne, etc.

Optionally, the pad body is hollow and forms an airbag. With the airbag, the pad body of the present disclosure has resilience and certain ductility, and may better fit the curve of human body. Additionally, the resilience may be adjusted by adjusting the amount of air inflation to thereby enhance comfort. Moreover, the inflatable pad body may also have a higher portability after the air is exhausted.

Optionally, a width of the pad body gradually decreases from a position where the first elevated segment is located to a position where the bridge part is located;

the width of the pad body gradually increases from the position where the bridge part is located to the position where the second elevated segment is located.

Further, a projection of the cross section of the pad body has a digit "8" shape.

When the width of the bridge part is reduced, the pad body may better support the hips of the human body.

Embodiments of the present disclosure provide some pad sizes suitable for most human bodies. For example, optionally, the minimal width of the pad body at the bridge part is within a range from 15 cm to 25 cm. A height from a lowest point of the bridge part to the bottom surface of the pad body is within a range from 3 cm to 9 cm; a height from a highest point of the elevated segment to the bottom surface of the pad body is within a range from 13 cm to 18 cm.

Besides, optionally, on a projection of a longitudinal section of the pad body, a curve segment from the highest point of the first elevated segment to the highest point of the second elevated segment is a period of a sine curve. Further, a length of a half wavelength of the sine curve is within a range from 10 cm to 15 cm.

Optionally, the pad body is made of a resilient material. The resilient material not only causes the pad portable, but also improves the comfort of the pad.

Optionally, the pad for improving sitting posture may further comprise:

a pressure sensor embedded at a top portion of the elevated segment; and an alarming device disposed in the bridge part; wherein the pressure sensor and the alarming device are in communicative connection.

The pressure sensor inlaid at the top portion of the elevated segment may flexibly sense the pressure when the posture is tilting and then trigger the alarming device to work.

BRIEF DESCRIPTION OF THE DRAWINGS

FIG. 1.1 is a stereoscopic schematic diagram of the pad for improving sitting posture according to the present disclosure;

FIG. 1.2 is a bottom view of the pad for improving sitting posture according to the present disclosure;

FIG. 1.3 is a front view of the pad for improving sitting posture according to the present disclosure;

FIG. 2.1 is a schematic diagram of a posture of a pelvis state when the human body tilts forward;

FIG. 2.2 is a schematic diagram of a posture of a pelvis state when the human body tilts backward;

FIG. 2.3 is a schematic diagram of the posture when the human body is sitting on the pad for improving posture according to the present disclosure;

FIG. 3.1 is a schematic diagram of a sitting posture of "X"-shaped legs of a human body;

FIG. 3.2 is a schematic diagram of a sitting posture of "O"-shaped legs of a human body; and FIG. 3.3 is a schematic diagram of the leg shape when the human body is sitting on the pad for improving posture according to the present disclosure.

REFERENCE NUMERALS

1—pad body; 11—first elevated segment; 12—bridge part; 13—second elevated segment;

2—lumbar vertebra;

3—pelvis

DETAILED DESCRIPTION OF THE PREFERRED EMBODIMENT

Embodiment I

In view that various kinds of pads in the prior art only passively support the human body, a first embodiment of the present disclosure provides a pad 1 for improving sitting posture, as shown in FIG. 1.1, comprising:

a pad body 1 that may be placed on a plane;

at least two elevated segments formed on the pad body 1, the two elevated segments being referred to as a first elevated segment 11 and a second elevated segment 13, respectively, wherein the first elevated segment 11 and the second elevated segment 13 are configured for supporting a pelvis 3 of a human body from the front and the back, respectively; and a bridge part 12 formed between the first elevated segment 11 and the second elevated segment 13, which are spaced with an interval, of the pad body, wherein the bridge part 12 is configured for supporting a part corresponding to a lower end of the pelvis or a lower end of a coccyx of the human body.

When a person is sitting on a chair, it is usually hard to maintain a correct posture for the sake of comfort. FIG. 2.1 and FIG. 2.2 schematically illustrate two typical incorrect postures. In FIG. 2.1, due to the sitting posture, the pelvis 3 tilts forward, causing the lumbar vertebra 2 to tilt forward and project forward. While in FIG. 2.2, the pelvis 3 tilts backward, causing the lumbar vertebra 2 to tilt backward. The backward or forward tilting of the pelvis 3 causes position displacement between sacrum and waist area, which forces the entire spine into an unnatural bent position, causing a negative impact on back health. If the muscles at the waist and back are in a tension state for a long time, it will cause pain at the lower back, and possibly at the upper back, the shoulder, the neck, and the arm, including headache, etc., in a short term, and in the long term, it will cause a plurality of diseases such as humpback, disc herniation, arthritis, and decreased vision.

However, in FIG. 2.3, when the person is sitting at the pad body 1 of the pad for improving sitting posture provided by the embodiments of the present disclosure, the pelvis 3 is in an ideal upright position, such that the lumbar vertebra 2 may be completely stretched. Because the connection between the sacrum and the lumbar vertebra 2 are soft and smooth without over-deformation at a single lateral side, there will be more space between respective joints for blood to circulate. In other words, the present disclosure may prevent diseases such as joint wear, arthritis, lumbar disc herniation.

The pad for improving sitting posture provided by the present disclosure limits the pelvis 3 at an appropriate upright position through the two elevated segments as provided, and supports, through the bridge part, the part at the lower end of the ischium or the part at the lower end of the coccyx, thereby holding the pelvis 3 in the upright position.

Moreover, this holding is a result of active participation of the musculature of the human body. This is because when sitting on the pad body 1, to maintain balance, the human body will adaptively optimize and adjust the posture of the body so as to minimize the pressure applied to respective parts of the pelvis 3.

With recurrent posture adjustment of the human body, these minor forces will activate once and again the muscles of the pelvic floor, particularly the deepest and largest muscle layers therein (including pubis tail muscle, musculi pubococcygeus, musculi coccygeus, iliac pterygoideus, metatarsus internal muscle, etc.), such that the pelvis floor mechanism may be supported like a trampoline, which relieves the pressure on respective organs (such as Bladder, vagina, uterus, prostate, rectum) inside the pelvis 3.

Those of normal skill in the art are clear that when the pelvis floor muscles are weak, there exist negative impacts on the organs in the pelvis floor. The organ degradation and sagging caused by insufficient pelvis floor muscle strength causes the organs to hardly get sufficient flood supply, which always causes dysfunction and even prolapses, resulting in the following problems: bladder weakness, recurrent cystitis, urinary incontinence, prostate problems, prolapse of uterus, rectum or vaginal, and acne, etc. However, in the embodiments of the present disclosure, the above problems may be well prevented and relieved with the stimulus and exercise by the pad to the pelvis floor muscles.

Besides, because the pelvis floor muscles are connected to the deep layers of the hips, legs, abdomen, and back, with activation of these muscles and cooperation of the upright sitting posture, the pad for improving sitting posture may even activate and exercise the deepest layer muscles of the legs and the whole torso.

Through active training of these deep muscles, some large muscle layers (e.g., latissimus, trapezius, deltoid, etc.) that are often in a state of tension may be more easily relaxed, and the equilibrium of the stress-strain between respective muscle layers may be coordinated, thereby capable of relieving fatigue and muscle pain and providing a good recovery effect.

With the continuous and adaptive positive stimulus to the body, the pad for improving sitting posture provided by the embodiments may also help for spinal orthosis, thereby further relieving and nourishing the intervertebral disc and preventing disc herniation.

When the spine is in an upright and stretched state, it may also affect the head posture. A smooth and curved transition between the atlas and the skull may extend along a central axis, such that more space for blood circulation may be created at the cervical joints. In this way, the cervical spine may support the weight of the head in a centrally aligned manner, thereby relaxing the muscle tissues of the neck and preventing occurrence of pains and cervical diseases.

In the present disclosure, the first elevated segment 11 and the second elevated segment 13 may be completely identical; the two symmetrical elevated segments may also be formed distinctively, with one higher and one lower.

Optionally, as shown in FIG. 1.2, a width of the pad body 1 gradually diminishes from the position where the first elevated segment 11 is located to the position where the bridge part 12 is located; and the width of the pad body 1 is gradually increased from the position where the bridge part 12 is located to the position where the second elevated segment 13 is located. When the width of the bridge part 12 is reduced, the pad body 1 may better support the hips of a human body and adapt itself to figures of different bodies.

It is particularly noted that when a person sits on a chair with an incorrect posture, the posture of the legs will also have a problem. FIGS. 3.1 and 3.2 schematically illustrate leg problems caused by two typical incorrect sitting postures.

FIG. 3.1 illustrates a sitting posture of "X"-shaped legs. FIG. 3.2 illustrates a sitting posture of "O"-shaped legs. Both of the two sitting postures will cause the hip joints stressed with insufficient blood supply to the surrounding muscles, which further generates a negative impact on the health of the waist and the back.

Please refer to FIG. 3.3. When adopting the pad for improving sitting posture provided according to the embodiments of the present disclosure, due to the separation of the elevated segments formed on the pad body 1, the hip joints may be released at a correct angle (generally 30°-45°); the structures surrounding the hip joints including muscles, ligaments, tendons, fascia may all be relaxed to get sufficient blood supply.

Further, a projection of the cross section of the pad body has a digit "8" shape. The cross section mentioned in the present disclosure refers to the plane schematically illustrated on the top view shown in FIG. 1.2. When the projection of the cross section of the pad body 1 is in a digit "8" shape, the edges of the pad body 1 are transitioned very smoothly, such that the pad may provide a better comfort.

Embodiments of the present disclosure provide some pad sizes suitable for most human bodies. It needs to be noted that the sizes below are all optional sizes, not compulsory sizes.

For example, as shown in FIG. 1.2, a minimum width (i.e., distance A in FIG. 1.2) of the pad body 1 at the bridge part 12 is within a range from 15 cm to 25 cm. As shown in FIG. 1.3, a height (i.e., distance B in FIG. 1.3) from a lowest point of the bridge part 12 to the bottom surface of the pad body 1 is within a range from 3 cm to 9 cm; a height (i.e., distance C in FIG. 1.3) from a highest point of the elevated segment to the bottom surface of the pad body 1 is within a range from 13 cm to 18 cm.

Besides, optionally, in a projection of a longitudinal section of the pad body 1, a curve segment from the highest point (i.e., point I in FIG. 1.3) of the first elevated segment 11 to the highest point (i.e., point II in FIG. 1.3) of the second elevated segment 13 is a period of a sine curve. Further, a length (i.e., distance D in FIG. 1.3) of a half wavelength of the sine curve is within a range from 10 cm to 15 cm.

The cross section mentioned in the present disclosure refers to the plane schematically illustrated on the front view shown in FIG. 1.3. By forming a shape similar to a sine curve, the general shape of the pad body 1 resembles a saddle shape, which may further improve the comfort.

Optionally, the pad body 1 is hollow and forms an airbag. With the airbag, the pad body 1 of the present disclosure has resilience and certain ductility, and may better fit the curve of human body. The air may be blown or pumped into the pad body 1; additionally, the resilience may be adjusted by adjusting the amount of air inflation to enhance comfort. Moreover, the inflatable pad body 1 may also have a higher portability after the air is exhausted. It needs to be noted that when the air bag is formed, the recommended sizes above refer to the sizes when the inflation rate of the airbag is 80% above.

Likewise, optionally, the pad body 1 is made of a resilient material. The resilient material not only causes the pad portable, but also improves the comfort of the pad.

In view of the above, compared with the prior art, the pad provided by the present disclosure enables relief of the hip joints and surrounding muscles of a human body by virtue of the separation function of the elevated segments, which guarantees that when seated on the pad, the legs of the human body maintain a correct relaxed angle, thereby facilitating blood supply; guarantees that the spine of a person constantly approaches to maintaining a correct curve, thereby further protecting lumbar vertebrae, because the bridge part 12 and the elevated segments surrounding the front and the back of the pelvis 3 straighten the pelvis 3; and further relaxes the cervical spine and surrounding neck musculature to prevent back pain and headache because the pad for improving the sitting posture provided by the present disclosure may stretch the spine of the human body, while the stretched spine may affect the head posture.

The present disclosure helps to relieve the following health issues: bladder weakness, recurrent cystitis, urinary incontinence, prostate problems, uterus, rectal or vaginal prolapse, acne, etc.

Additionally, it needs to be particularly noted that the pad for improving sitting posture provided by the present disclosure may not only be used as a pad, but also may be used as a back cushion. For example, the pad may abut against a chair back, and then the elevated segments abut against the back of the human body, thereby implementing a massage effect. Or, the pad may be used as a "U"-shaped pillow.

Moreover, the pad is not limited to being used by an adult, which may also be used as a child toy. For example, a plurality of pads are aligned into a row, thereby forming a groove for a child to lie in at the bridge parts 12 of respective pads. More application examples will not be listed here.

Embodiment II

A second embodiment of the present disclosure provides an alternative pad for improving sitting posture. The second embodiment is a further improvement of the first embodiment. The main improvement lies in that in the second embodiment of the present disclosure, the pad for improving sitting posture may further comprise:

a pressure sensor embedded at a top portion of the elevated segment; and an alarming device disposed in the bridge part 12; wherein the pressure sensor and the alarming device are in communicative connection.

The pressure sensor embedded at the top portion of the elevated segment may flexibly sense the pressure when the posture is tilting and then trigger the alarming device to work.

Particularly, the pressure sensor may be disposed at a side of the top portion of the elevated segment closer to the bridge part 12;

wherein the alarming device may be a vibration or voice transducer. The vibration sensor is particularly recommended. When the top portions of the elevated segments sense a pressure exceeding a threshold, it usually indicates that the sitting posture of the person sitting thereon have a large amplitude of offset. At this point, the vibration generated by the vibration transducer may not only play a role of alarming, but also may massage the muscles at the pelvis floor, the lower end of the coccyx, and the lower end of the ischium of the human body, functioning to relieve the pressure.

Those of normal skill in the art may understand that many technical details provided in the various embodiments above are only for the readers to understand better. However, the technical solutions as claimed in the claims of the present application may be still implemented substantially even without these technical details or various changes and modifications of the embodiments above. Therefore, in actual applications, various alternations to the embodiments may be done in aspects of forms and details without departing from the spirit and scope of the present disclosure.

What is claimed is:

1. A pad for improving sitting posture, comprising:

a pad body being inflatable, and comprising a substantially flat bottom surface adapted to be placed on a planar, horizontal support surface and the shape of the bottom surface being substantially eight-shaped;

at least two elevated segments formed on the pad body, the two elevated segments being a first elevated segment and a second elevated segment, respectively, and arranged in a location that reaches and supports a pelvis of a user from the front and the back, respectively; and a bridge part formed between the first elevated segment and the second elevated segment and having a dimension that fits between two legs of the user and allowing the first elevated segment protruding to the front of the user and the second elevated segment protruding to the back of the user so that the two elevated segments are at locations of supporting the pelvis of the user, wherein the bridge part is configured for supporting a lower end of an ischium or a lower end of a coccyx of the user; and wherein the pad body has a front view, a rear view, a top view, and a bottom view, each of which having a bilateral symmetry.

2. The pad for improving sitting posture according to claim 1, wherein the pad body is hollow and forms an air bag.

3. The pad for improving sitting posture according to claim 1, wherein a width of the pad body gradually decreases from a position where the first elevated segment is located to a position where the bridge part is located; and the width of the pad body gradually increases from the position where the bridge part is located to the position where the second elevated segment is located.

4. The pad for improving sitting posture according to claim 3, wherein a minimum width of the pad body at the bridge part is in a range from 15 cm to 25 cm.

5. The pad for improving sitting posture according to claim 1, wherein a height from a lowest point of the bridge part to a bottom surface of the pad body is within a range from 3 cm to 9 cm; and a height from a highest point of the elevated segment to the bottom surface of the pad body is within a range from 13 cm to 18 cm.

6. The pad for improving sitting posture according to claim 1, wherein in a projection of a longitudinal section of the pad body, a curve segment from the highest point of the first elevated segment to the highest point of the second elevated segment is a period of a sine curve.

7. The pad for improving sitting posture according to claim 6, wherein a minimum width of the pad body at the bridge part is in a range from 15 cm to 25 cm.

8. The pad for improving sitting posture according to claim 1, wherein the pad body is made of a resilient material.

9. The pad for improving sitting posture according to claim 1, further comprising: a pressure sensor embedded at a top portion of the elevated segment; and an alarming device disposed in the bridge part; wherein the pressure sensor and the alarming device are in communicative connection.

* * * * *